US005226372A

United States Patent [19]

Frenkel et al.

[11] Patent Number: 5,226,372

[45] Date of Patent: Jul. 13, 1993

[54] SLIP PALLET WITH A CUSHIONING EFFECT

[75] Inventors: Robert L. Frenkel, Englewood; Ferdinand Weits, Westminster; John S. Todor, Jr., Arvada; G. Robert Mitchell, Morrison, all of Colo.

[73] Assignee: Coors Brewing Company, Golden, Colo.

[21] Appl. No.: 507,673

[22] Filed: Apr. 10, 1990

Related U.S. Application Data

[63] Continuation-in-part of Ser. No. 310,327, Feb. 13, 1989, abandoned.

[51] Int. Cl.[5] ..... B65D 19/00

[52] U.S. Cl. ..... 108/51.1; 206/593; 206/594; 108/53.3; 108/901; 248/346

[58] Field of Search ..... 108/901, 51.1, 53.3, 108/55.3, 57.1; 248/346, 633; 206/593, 594, 585, 591

[56] References Cited

U.S. PATENT DOCUMENTS

| | | | |
|---|---|---|---|
| 3,199,468 | 8/1965 | Sullivan | 108/53.3 |
| 3,231,454 | 1/1966 | Williams | 206/594 |
| 3,545,249 | 12/1970 | Brown | 248/346 X |
| 3,776,145 | 12/1973 | Anderson et al. | 108/51.1 |
| 3,850,116 | 11/1974 | Mackes | 108/51.1 |
| 3,892,902 | 7/1975 | Ilukowicz | 206/593 X |
| 4,042,127 | 8/1977 | Brossia | 108/51.3 X |
| 4,507,348 | 3/1985 | Nagata et al. | 108/51.1 X |
| 4,562,718 | 1/1986 | Dunk | 108/53.3 |

FOREIGN PATENT DOCUMENTS

| | | | |
|---|---|---|---|
| 2625346 | 12/1977 | Fed. Rep. of Germany | 248/633 |

*Primary Examiner*—Peter A. Aschenbrenner
*Attorney, Agent, or Firm*—Klaas, Law, O'Meara & Malkin

[57] ABSTRACT

A slip pallet formed as a square or rectangular sheet of a plastic material having a central body portion on which a load, such as an array of loaded cardboard boxes, is supported and a plurality of lip portions extending outwardly and upwardly from the central body portion wherein at least the central body portion is provided with a plurality of spaced apart dimples formed in the top surface of the central body portions so that a plurality of spaced apart projections extend downwardly from the bottom surface of the central body portion to provide a cushioning support for the load and wherein at least a portion of each projection is a segment of a sphere. In other embodiments, the dimples are integral solid projections, each of which may be provided with a cavity having an opening in the outer surface thereof.

12 Claims, 3 Drawing Sheets

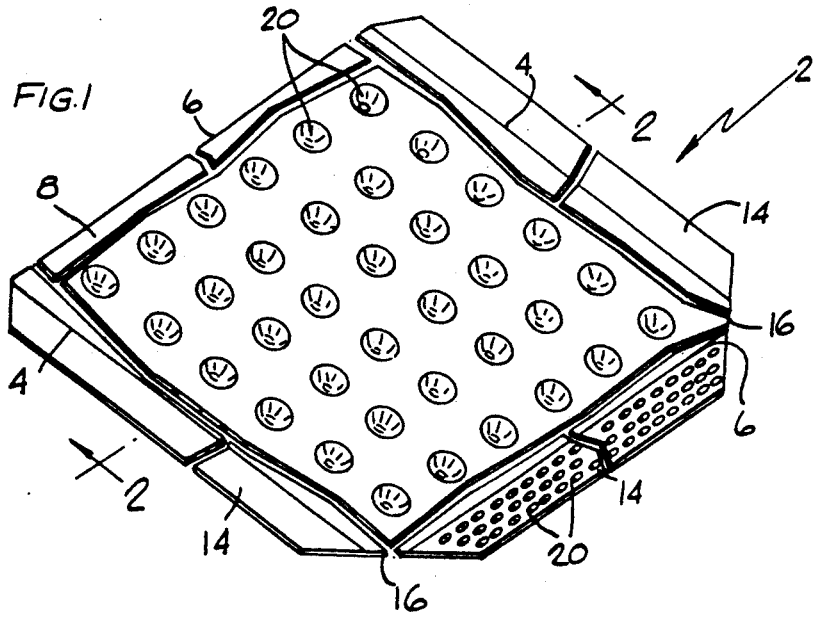
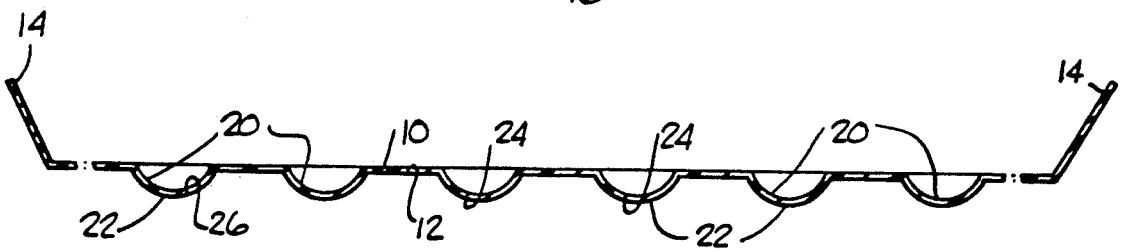
FIG. 2
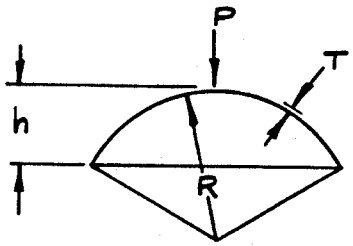
FIG.8
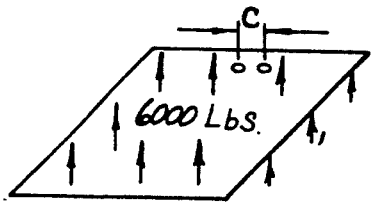
FIG. 9

SLIP PALLET WITH A CUSHIONING EFFECT

This application is a continuation-in-part of U.S. patent application Ser. No. 310,327 filed Feb. 13, 1989, now abandoned.

FIELD OF THE INVENTION

This invention relates generally to pallets for use in supporting loads during shipment or storage of materials and more specifically to a slip pallet with a cushioning effect for a load supported thereon, such as an array of cardboard boxes holding beverage containers.

BACKGROUND OF THE INVENTION

Plastic slip pallets, such as those described in U.S. Pat. Nos. 3,776,145; 3,850,116 and 4,042,127, have been used for ease of storage and handling of a load of boxes supported thereon in a warehouse, a manufacturing facility and during shipment by rail or by truck. A plastic slip pallet has a lip means adapted to be gripped by a lift truck and held in tension while slipping a platen, or spatula-like member, of the lift truck under the plastic slip pallet. The platen then lifts the plastic slip pallet and the boxes supported thereon and transports them to a desired location where the slip pallet and the boxes are pushed off the platen. A recent development in plastic slip pallets is disclosed in U.S. Pat. No. 4,507,348 to Nagata et al. The slip pallet in Nagata et al. comprises a support member comprising an interlining core sandwiched between and secured to two liners and has a flap portion continuous to the support member through a bending portion in which the interlining core and the two liners are compressed together and fused into one continuous layer to provide a hinge effect. While the corrugated slip pallet of Nagata et al. does provide a cushioning effect, it is expensive to manufacture.

BRIEF DESCRIPTION OF THE INVENTION

This invention provides a slip pallet with a cushioning effect comprising a sheet of single ply plastic material having a plurality of spaced apart dimples formed therein to provide a cushioning effect while retaining its load supporting properties.

In the preferred embodiment of the invention. the slip pallet is formed from a single ply of plastic material, such as polypropylene or high density polyethylene, having a thickness of between about 0.040 and 0.125 inch and a stiffness measurement in the range of 120,000 to 180,000 psi as determined by ASTM specification D 790, Method 1—Procedure B. The slip pallet has opposite pairs of generally parallel edges to define a central body portion for supporting a load, such as an array of cardboard boxes holding filled beverage containers. The central body portion originally has a generally planar top surface and a generally planar bottom surface. A plurality of spaced apart dimples are formed downwardly from the top surface so as to form a plurality of spaced apart projections extending downwardly from the bottom surface. The dimples are generally spherical segments having an outer radius of between about 0.1875 and 0.563 inch and a depth from the bottom surface to the crest of the dimple of between about 0.094 and 0.281 inch so that the projections formed thereby have outer surfaces which are segments of a sphere. The projections have a density of between about 0.75 to 2.00 per square inch and a surface area of between about 60 to 95 percent of the entire surface area of the top surface. At least one integral lip portion extends outwardly and upwardly from one of the edges. Suitable materials for forming the plastic slip pallet are set forth in U.S. Pat. No. 3,776,145 from Column 8, Line 43, to Column 9, Line 15. The preferred embodiment of this invention uses a copolymer of polypropylene marketed by Himont U.S.A., Inc., of Wilmington, Del., under the trade designation pro-fax® 8623.

In another preferred embodiment of the invention, a plurality of integral solid portions project downwardly from the bottom surface of the pallet. The integral solid portion are sized and located similarly to the above-described dimples. In a further embodiment of the invention, a cavity is formed in the integral solid portion with the cavity having an opening in the bottom portion of the outer surface of the downwardly projecting portion.

BRIEF DESCRIPTION OF THE DRAWINGS

An illustrative and presently preferred embodiment of the invention is shown in the accompanying drawings in which:

FIG. 1 is a perspective view of the preferred embodiment of the invention broken away to show an enlarged portion;

FIG. 2 is a cross-sectional view taken on the line 2—2 of FIG. 1;

FIGS. 8 and 9 are illustrations for use with the formula set forth in the specification.

DETAILED DESCRIPTION OF THE INVENTION

Figure 3:
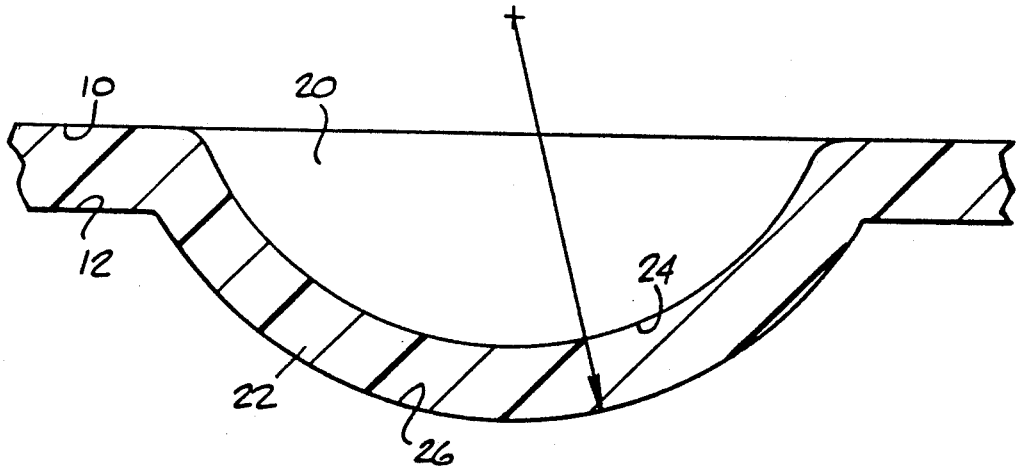
FIG. 3 is an enlarged cross-sectional view similar to a portion of FIG. 2 with no load supported thereon.

The preferred embodiment of the invention is illustrated in the drawing and comprises a slip pallet 2 formed from a single ply of plastic material such as polypropylene or a high density polyethylene or other materials having similar characteristics. The plastic material has a thickness between about 0.040 and 0.125 inch and a stiffness measurement in the range of 120,000 to 180,000 psi and preferably a thickness of about 0.051 of an inch and a stiffness measurement of about 155,000 psi as determined by ASTM specification D 790, Method 1—Procedure B. The slip pallet 2 has opposite pairs of generally parallel edges 4 and 6 to define a central body portion 8 originally having a generally planar top surface 10 and a generally planar bottom surface 12. Integral lip portions 14 are formed in a conventional manner and extend outwardly and upwardly from the generally parallel edges 4 and one of the generally parallel edges 6. If desired, the slip pallet 2 may have diagonally cut corners 16 preventing edges 4 and 6 from intersecting.

A plurality of dimples 20 are formed in the top surface 10 so that a plurality of projections 22 extend downwardly from the bottom surface 12. The dimples 20 have an inner surface 24 that is a segment of a sphere and the projections 22 have an outer surface 26 which is a segment of a sphere. The radius of the outer surface 26 is between about 0.1875 and 0.563 inch and the projections 22 have a depth, measured from the bottom surface 12 to the crest of the projection 22, of between about 0.094 and 0.281 inch. The centers for the spheres of the outer surfaces 26 are located above the top surface 10 a distance equal to one-half of the radius minus the thickness between the planar portions of the top and bottom surfaces 10 and 12. In accordance with this invention, the depth of each projection 22 from the bottom surface 12 will be about one-half the radius of the outer surface 26. The dimples 20 have centers which are spaced apart a distance of between about 0.75 and 1.50 inches and have a density of between about 0.75 and 2.00 per square inch and a surface area of between about 65 and 90 percent of the top surface 10. As illustrated in FIG. 1, the dimples 20 preferably extend in spaced apart parallel rows which rows are parallel to the opposite parallel edges 4 and perpendicular to the opposite parallel edges 6. There are no dimples 20 in the lip portions 14 integral with the opposite edge portions 4, but there are dimples in the lip portion 14 integral with the one edge 6.

In FIG. 3, there is illustrated one dimple 20 of a central body portion 8 wherein the thickness of the plastic sheet between dimples 20 is about 0.051 inch. The outer surface 26 of each of the dimples 20 has a radius of about 0.250 inch and are on spaced apart centers of about 1.00 inch. The center for the radius is located about 0.074 inch above the top surface 10. Each projection 22 has a depth of about 0.125 inch from the bottom surface 12 to the crest of the projection 22. A slip pallet 2 having the dimples 20 as described above is capable of supporting loads up to about 10,000 pounds and still providing a cushioning effect. The linear extent between the parallel edges 6 is about 40.50 inches, and the linear extent between the parallel edges 4 is about 46.00 inches. There are 45 rows of dimples 20 between the parallel edges 6 and the integral lip 14, and 49 rows of dimples between the parallel edges 4. Each lip 14 extends from the edges 4 or 6 a linear distance of about 3 inches.

Figure 4:
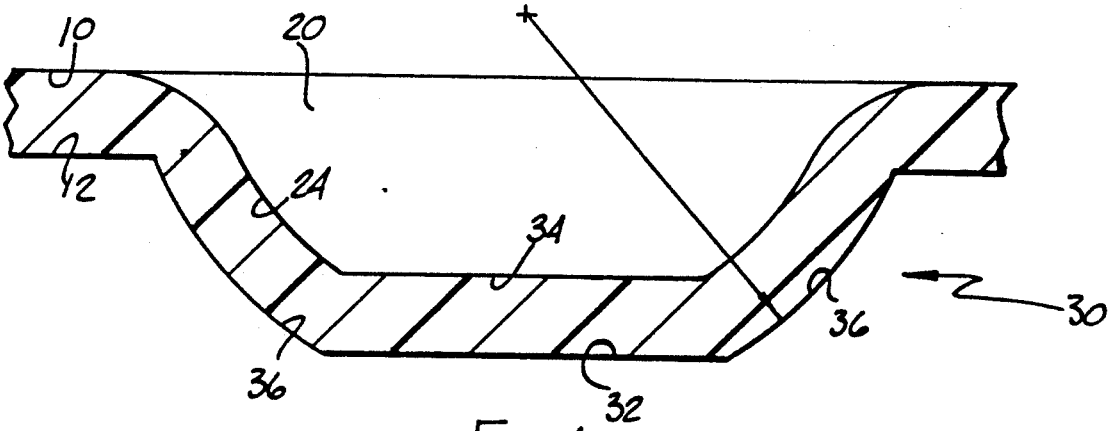
FIG. 4 is an enlarged cross-sectional view of another preferred embodiment of the invention with no load supported thereon.

In some instances, the use of a slip pallet 2 as illustrated in FIGS. 1–3 present some problems in that there is a tendency for the slip pallet 2 to slide when being supported on a platen as illustrated in U.S. Pat. No. 3,776,145. In FIG. 4, there is illustrated a slip pallet 30 where a portion 32 of the outer surface 24 is relatively planar so that the portion 34 of the inner surface 26 is also relatively planar so as to provide a greater surface area for contact with the surface of the platen so as to provide greater frictional forces to prevent the sliding of the slip pallet 30 on the platen. The arcuate outer surface 36 is a frustum of a sphere having a radius of between about 0.185 and 0.563 inch and wherein the center of the sphere is located a distance above the top surface 10 equal to one-half the radius minus the thickness between the planar portions of the top and bottom surfaces. The portion 32 has a depth of between about 0.061 and 0.248 inch and the planar surface 32 has a diameter of between about 0.1875 and 0.563 inch. In a preferred embodiment of the dimple of FIG. 4, the surface 32 has a diameter of about 0.25 inch and a depth of 0.092 inch from the bottom surface 12. The arcuate outer surface 36 has a radius of about 0.25 wherein the center of the sphere is located 0.074 inch above the top surface 10.

Figure 5:
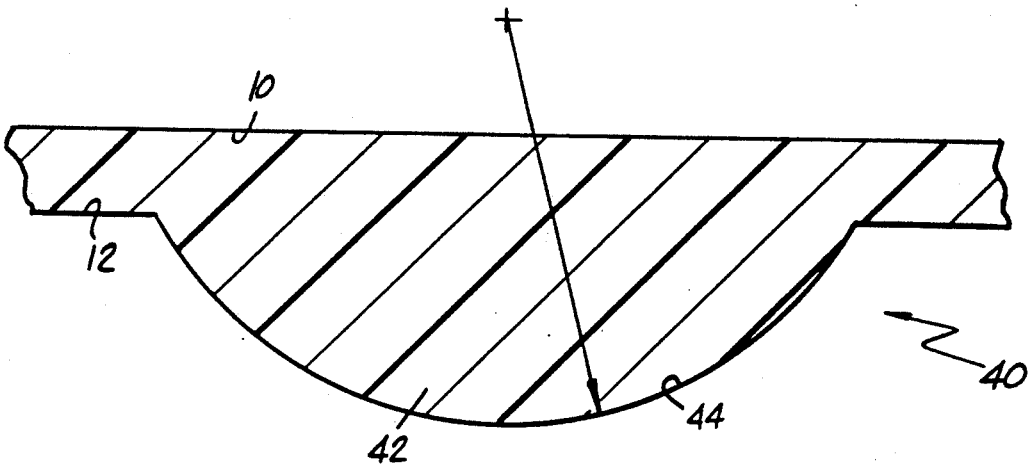
FIG. 5 is an enlarged cross-sectional view of another preferred embodiment of the invention with no load supported thereon.

Another preferred embodiment of the invention is illustrated in FIG. 5 wherein the pallet 40 has a generally planar top surface 10 and a generally planar bottom surface 12. A plurality of integral solid portions 42 project downwardly from the bottom surface 12. Each integral solid portion is a segment of a sphere with the outer surface 44 having a radius of about 0.250 inch with the center thereof being spaced about 0.074 inch above the top surface 10. The integral solid portions are sized and located in a relationship similar to that described above in relation to the dimples 20 of FIGS. 1–3. The cushioning effect is secured by the pallet 40 by the flexing of the material between the integral solid portions 42 and the roundness of the outer surface 44 which permits slight rotation of the integral solid portions 42. While the embodiment illustrated in FIG. 5 may not provide a cushioning effect equal to that in FIG. 3, it is more economical to manufacture.

Figure 6:
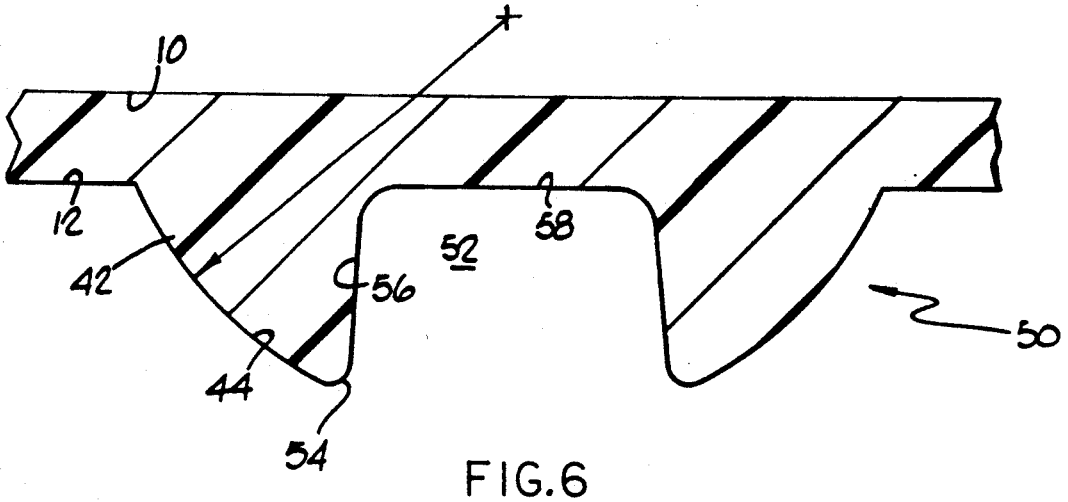
FIG. 6 is an enlarged cross-sectional view of another preferred embodiment of the invention with no load supported thereon.

Another preferred embodiment of the invention is illustrated in FIG. 6 and which is similar to that embodiment illustrated in FIG. 5. The pallet 50, illustrated in FIG. 6, has a cavity 52 formed in the integral solid portion 43. The cavity 52 has an opening 54 in the outer surface 44 and has a conical sidewall 56. The top surface 58 lies in the same plane as the bottom surface 12. The diameter of the opening 54 is about 0.020 inch. As illustrated in FIG. 6, the opening 54 is located at the bottom portion of the outer surface 44. The pallet 50, illustrated in FIG. 6, should provide a cushioning effect similar to the pallet 30 and is more economical to manufacture.

Figure 7:
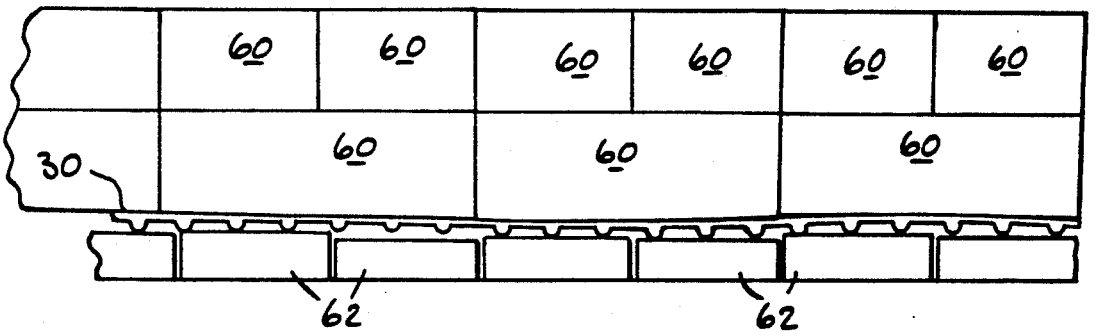
FIG. 7 is a schematic illustration of a portion of a loaded railroad box car.

In FIG. 7, there is a schematic illustration of an array of boxes 60 each of which contains a plurality of filled beverage containers which are supported on a pallet 30. The floor of a railroad car in which the pallet 30 is located comprises a plurality of floor boards 62 which may be of differing thicknesses so as to provide an uneven surface on which the pallet 30 is supported. As illustrated in FIG. 7, the pallet 30 is able to compensate for the uneven surface and still provide a cushioning effect for the filled beverage containers in the array of boxes 60. Customary adjustable bulkheads and dunnage are used to attempt to limit lateral movement of the array of boxes 60.

When the slip pallets of this invention are used in the shipment by truck or rail of filled beverage containers packed in boxes, the weight on each slip pallet is between about 2,100 and 2,600 pounds. In the manufacture of the beverage containers, it is most desirable to make them having wall thicknesses as thin as possible. As a result, they are subject to rupture when too great a force is placed thereon. During the shipment of filled beverage containers, the rocking and jarring motion of the carrier places great forces on the boxes in which the beverage containers are packaged. This invention provides a pallet for providing a cushioning effect for the beverage containers so as to reduce substantially the number of non-saleable beverage containers after shipment particularly over long distances of several hundreds of miles. In normal practice, one slip pallet is loaded on top of another slip pallet so that the load on the bottom slip pallet is between about 4,200 and 5,200 pounds. During shipment, the truck or rail car may periodically place additional loads on the slip pallets. During such additional loads, the projections will be depressed in an amount relative to the additional load, but after the additional load has been removed, the projections will resile to their configuration prior to the additional load.

The above-described preferred embodiment is based on a load on the bottom slip pallet of between about 4,200 and 5,200 pounds. The specific construction of the slip pallet with dimples for any desired load may be calculated in the following manner. The conventional formula for the deflection of a sphere, illustrated in FIG. 6, wherein the dimple 20 has been inverted for explanation purposes only, is:

$$\text{deflection } y = \frac{APR^2}{16\pi D}$$

where $$D = \frac{Et^3}{12(1-\gamma)}$$

R=outer radius of the dimple
where $\gamma$=poissons ratio
A—is from the following table

| α | 0 | 1 | 2 | 3 | 4 | 5 | 6 |
|---|---|---|---|---|---|---|---|
| A | 1 | .996 | .935 | .754 | .406 | .321 | .210 |

wherein $$\alpha = 2\sqrt[4]{3(1-\gamma)} \times \sqrt{h/t}$$

E=Young's modulus of elasticity
t=final thickness
where final thickness $$t = \text{initial thickness } (F) \times \left(\frac{l}{c}\right)^2$$

$$t = (F)\left[\frac{(2)\sqrt{(R^2-d^2)}}{D\cos^{-1}d/R}\right]^2$$

where
F=flat sheet thickness
R=outer radius of the dimple
d=distance R is spaced from centerline of F
l=diameter of the bottom portion s of the segment of the sphere
c=circumference of the bottom portion s of the segment of the sphere
for a semi-sphere d=0 and D=2R $$t = (F)\left[\frac{2R}{D(\pi/2)}\right]^2 = \frac{4FR^2}{D^2\left(\frac{\pi}{2}\right)^2} = \frac{F}{\left(\frac{\pi}{2}\right)^2}$$

The conventional formula for P which the load distribution, illustrated in FIG. 7, is:

$$P = \frac{\text{load lbs/ft}^2}{(12''/C)(12''/C)} = \frac{\text{load}(C^2)}{144} = \text{lbs./dimple}$$

where C is space between centers of the dimples.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A shock absorbing pallet for comprising:
a sheet of single ply plastic material having a thickness of between about 0.040 and 0.125 of an inch and a stiffness measurement in the range of between about 120,000 and 180,000 psi as determined by ASTM specification D 790, Method 1—Procedure B;
said sheet having opposite pairs of parallel edges defining a central body portion for supporting a load;
an integral lip portion extending outwardly and upwardly from at least one of said edges;
said central body portion having a top surface and a bottom surface with said load being in contact with said top surface;
a plurality of spaced apart dimples in said top surface forming a plurality of spaced apart openings in said top surface and a plurality of spaced apart projections on said bottom surface thereof, said dimples and said projections being resilient so that said dimples and said projections will provide a cushioning effect whenever an additional force is placed on said load and resile when said additional force is removed; and
said top and bottom surfaces being generally planar except for said dimples and projections.

2. A pallet as in claim 1 wherein:
said at least one lip portion has a top surface and a bottom surface; and
a plurality of spaced apart dimples in said top surface of said at least one lip portion forming a plurality of spaced apart projections on said bottom surface thereof.

3. A pallet as in claim 1 wherein:
said plurality of spaced apart dimples extend in spaced apart parallel rows having the same number of dimples and which rows are parallel to one pair of said opposite pairs of parallel edges and perpendicular to the other pair of said opposite pairs of parallel edges.

4. A pallet as in claim 3 wherein:
said at least one lip portion has a top surface and a bottom surface; and
a plurality of spaced apart dimples in said top surface of said at least one lip portion forming a plurality of spaced apart projections on said bottom surface thereof.

5. A pallet as in claim 4 wherein:
each of said dimples in said at least one lip portion is in alignment with one of said spaced apart parallel rows of dimples.

6. A pallet as in claim 1 wherein:
each of said projections having a shape corresponding to a frustum of a sphere wherein the planes forming said frustum are parallel to said bottom surface.

7. A shock absorbing pallet for supporting a load comprising:
a sheet of single ply plastic material having a thickness of between about 0.040 and 0.125 of an inch and a stiffness measurement in the range of between about 120,000 and 180,000 psi as determined by ASTM specification D 790, Method 1—Procedure B;

said sheet having opposite pairs of parallel edges defining a central body portion for supporting a load;

an integral lip portion extending outwardly and upwardly from at least one of said edges;

said central body portion having a top surface and a bottom surface;

a plurality of spaced apart dimples in said top surface forming a plurality of spaced apart projections on said bottom surface thereof, said dimples and said projections being resilient so that said dimples and said projections will provide a cushioning effect whenever an additional force is placed on said load and resile when said additional force is removed;

each of said projections having an outer surface which is a frustum of a sphere; and said top and bottom surfaces being generally planar except for said dimples and projections.

8. A pallet as in claim 7 wherein:

said plurality of dimples are located on spaced apart centers of between about 0.750 and 1.50 inches with each circular segment thereof having a radius of between about 0.1875 and 0.563 inch;

each projection has a depth of between about 0.094 and 0.281 inch from said bottom surface to the crest of said projection; and said dimples have a density of between about 0.75 and 2.00 per square inch.

9. A shock absorbing pallet for supporting a load comprising:

a sheet of single ply plastic material having a thickness of between about 0.040 and 0.125 of an inch and a stiffness measurement in the range of between about 120,000 and 180,000 psi as determined by ASTM specification D 790, Method 1—Procedure B;

said sheet having opposite pairs of parallel edges defining a central body portion for supporting a load;

an integral lip portion extending outwardly and upwardly from at least one of said edges;

said central body portion having a generally planar top surface and a generally planar bottom surface; and a plurality of spaced apart integral solid projections extending downwardly from said bottom surface and cooperating with said central body portion to provide a cushioning effect whenever an additional force is placed on said load and resile when said additional force is removed.

10. A pallet as in claim 9 wherein:

each of said integral solid projections having an outer surface having the shape of a segment of a sphere.

11. A pallet as in claim 9 and further comprising:

a cavity formed in each of said integral solid projections and having an opening in the bottom portion of said outer surface.

12. A pallet as in claim 11 wherein:

said cavity having a conical sidewall and a generally planar top wall lying in the same plane as said bottom surface.

* * * * *